US010327484B2

(12) United States Patent
Giangeruso

(10) Patent No.: US 10,327,484 B2
(45) Date of Patent: Jun. 25, 2019

(54) ATHLETIC GARMENT WITH INTERCHANGEABLE VENTILATED SLEEVES

(71) Applicant: April R. Giangeruso, New York, NY (US)

(72) Inventor: April R. Giangeruso, New York, NY (US)

( * ) Notice: Subject to any disclaimer, the term of this patent is extended or adjusted under 35 U.S.C. 154(b) by 233 days.

(21) Appl. No.: 15/441,914

(22) Filed: Feb. 24, 2017

(65) Prior Publication Data

US 2018/0242660 A1 Aug. 30, 2018

(51) Int. Cl.

| | |
|---|---|
| ***A41D 15/00*** | (2006.01) |
| ***A41D 13/00*** | (2006.01) |
| ***A41D 27/10*** | (2006.01) |
| ***A41D 27/28*** | (2006.01) |

(52) U.S. Cl.

CPC ..... *A41D 15/002* (2013.01); *A41D 13/0015* (2013.01); *A41D 27/10* (2013.01); *A41D 27/28* (2013.01); *A41D 2300/32* (2013.01); *A41D 2300/322* (2013.01)

(58) Field of Classification Search

CPC ... A41D 136/0015; A41D 27/10; A41D 27/28
USPC ..... 2/69, 115, 125, 108
See application file for complete search history.

(56) References Cited

U.S. PATENT DOCUMENTS

| | | | | |
|---|---|---|---|---|
| 1,489,046 | A | 4/1924 | Tracy | |
| 2,122,873 | A | 7/1938 | Shuster | |
| 2,313,519 | A * | 3/1943 | Cuttler | A41D 27/10 2/126 |
| 2,334,498 | A | 11/1943 | Meta | |
| 2,677,131 | A | 5/1954 | Shuster | |
| 3,023,419 | A | 3/1962 | Zurbaran | |
| 4,006,495 | A | 2/1977 | Jones | |
| 5,182,812 | A * | 2/1993 | Goldsby | A61H 36/00 2/227 |
| 5,729,836 | A * | 3/1998 | Ewing | A41B 11/003 2/409 |
| 6,298,485 | B1 | 10/2001 | Heller | |
| 7,392,549 | B1 | 7/2008 | Barber | |
| 8,075,366 | B1 * | 12/2011 | Jaksic | A41C 3/08 2/105 |
| 8,555,414 | B2 | 10/2013 | Davis et al. | |
| 9,265,289 | B1 | 2/2016 | Green et al. | |
| 9,351,527 | B1 | 5/2016 | Costanza | |
| 2007/0050879 | A1 | 3/2007 | Etzold et al. | |
| 2010/0125930 | A1 | 5/2010 | Burrell | |

(Continued)

FOREIGN PATENT DOCUMENTS

| | | |
|---|---|---|
| CN | 204904849 U | 12/2015 |
| CN | 204908008 U | 12/2015 |

*Primary Examiner* — Gloria M Hale
(74) *Attorney, Agent, or Firm* — Olav M. Underdal; IDP Patent Services

(57) ABSTRACT

An adaptable garment includes a garment body and right and left removable sleeves, attached to right and left partial upper peripheries of respectively right and left arm openings. The right and left removable sleeves can be attached with zippers or hook and loop fasteners. The adaptable garment can be an adaptable leotard. An adaptable garment system includes a garment body and a plurality of removable sleeve pairs, which can include a pair of short sleeves and a pair of long sleeves.

8 Claims, 6 Drawing Sheets

(56) References Cited

U.S. PATENT DOCUMENTS

| | | | | |
|---|---|---|---|---|
| 2011/0307992 | A1* | 12/2011 | Martinson | A41D 15/00 2/69 |
| 2012/0222187 | A1 | 9/2012 | McLaren et al. | |
| 2014/0007314 | A1 | 1/2014 | Davis et al. | |
| 2015/0033451 | A1 | 2/2015 | Bradshaw | |
| 2015/0071978 | A1 | 3/2015 | Chang | |

* cited by examiner

ATHLETIC GARMENT WITH INTERCHANGEABLE VENTILATED SLEEVES

CROSS-REFERENCE TO RELATED APPLICATIONS

N/A.

FIELD OF THE INVENTION

The present invention relates generally to the field of clothing for dancing and gymnastics, and more particularly to leotards designed with removable sleeves.

BACKGROUND OF THE INVENTION

Leotards are commonly used for dancing and gymnastics. They can be made with varying designs, including no sleeves, as well as short and long sleeves.

Dancers and gymnasts may become overheated during long practice session and may wish to change to a shorter sleeve, or a sleeveless leotard. Additionally, a wearer may wish to change the visual appearance. However, it may be impractical to use several leotards, and even shorter sleeve leotard versions are typically completely closed around the torso area and may not offer adequate ventilation.

As such, considering the foregoing, it may be appreciated that there continues to be a need for novel and improved devices and methods for adaptable leotards with improved ventilation.

SUMMARY OF THE INVENTION

The foregoing needs are met, to a great extent, by the present invention, wherein in aspects of this invention, enhancements are provided to the existing model of leotards.

In an aspect, an adaptable garment, which can be an adaptable leotard, can include:

a) a garment body, which can be a leotard body, comprising right and left arm openings; and b) right and left removable sleeves that are removably attached to the leotard body.

In a related aspect, the removable sleeves can be partially attached to the garment body, such that that armpit apertures are defined between the garment body and the removable sleeves.

In related aspects, the removable sleeves can be attached to the garment body with zippers, hook and loop fastener, or other types of fastening mechanisms.

In another aspect, an adaptable garment system can include:

a) a garment body; and b) a plurality of removable sleeve pairs, including first and second pairs of removable sleeves.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
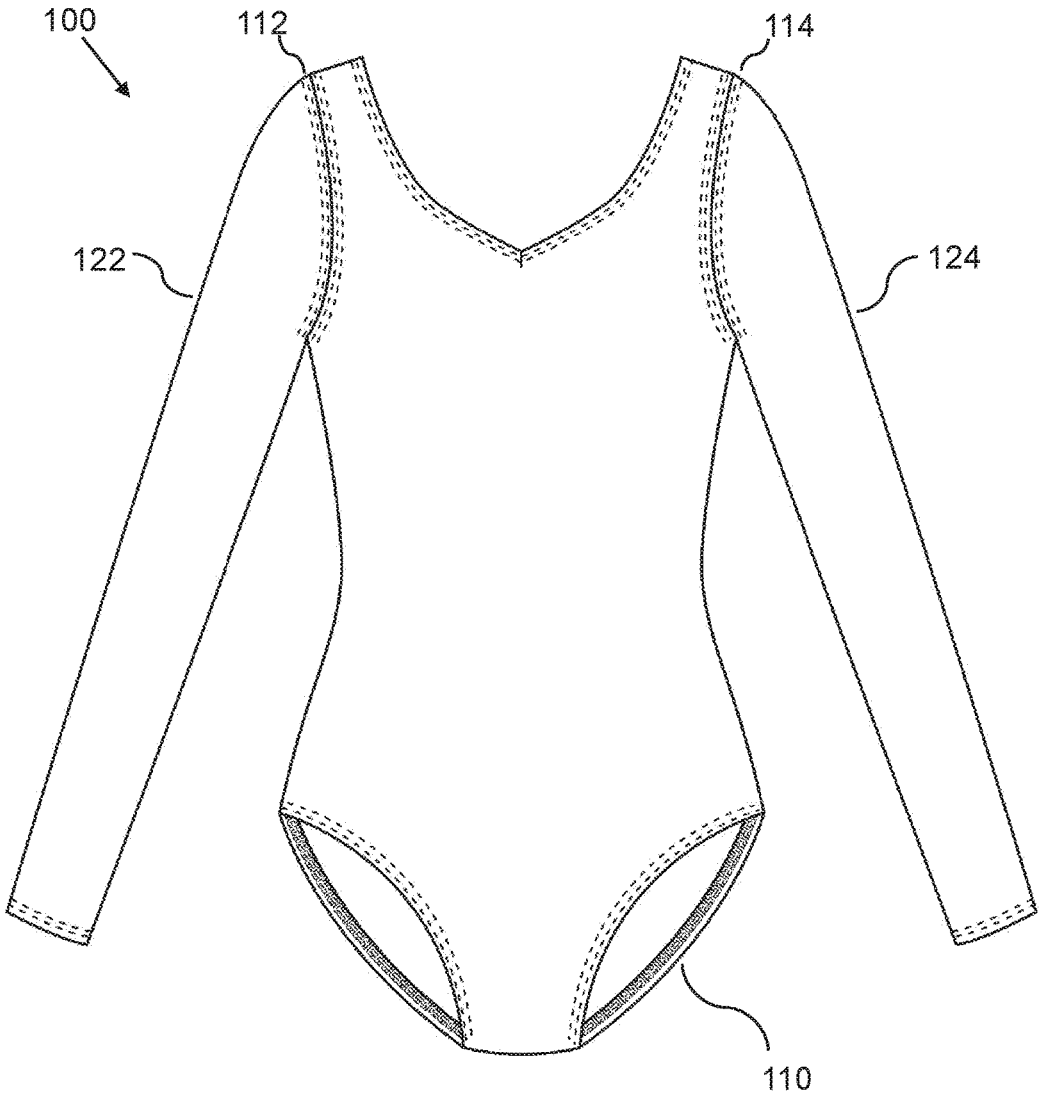
FIG. 1 is a front view of an adaptable leotard with removable sleeves, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a leotard with removable sleeves 100 with reference to FIG. 1, in such manner that like reference numerals refer to like components throughout; a convention that we shall employ for the remainder of this specification.

Figure 2:
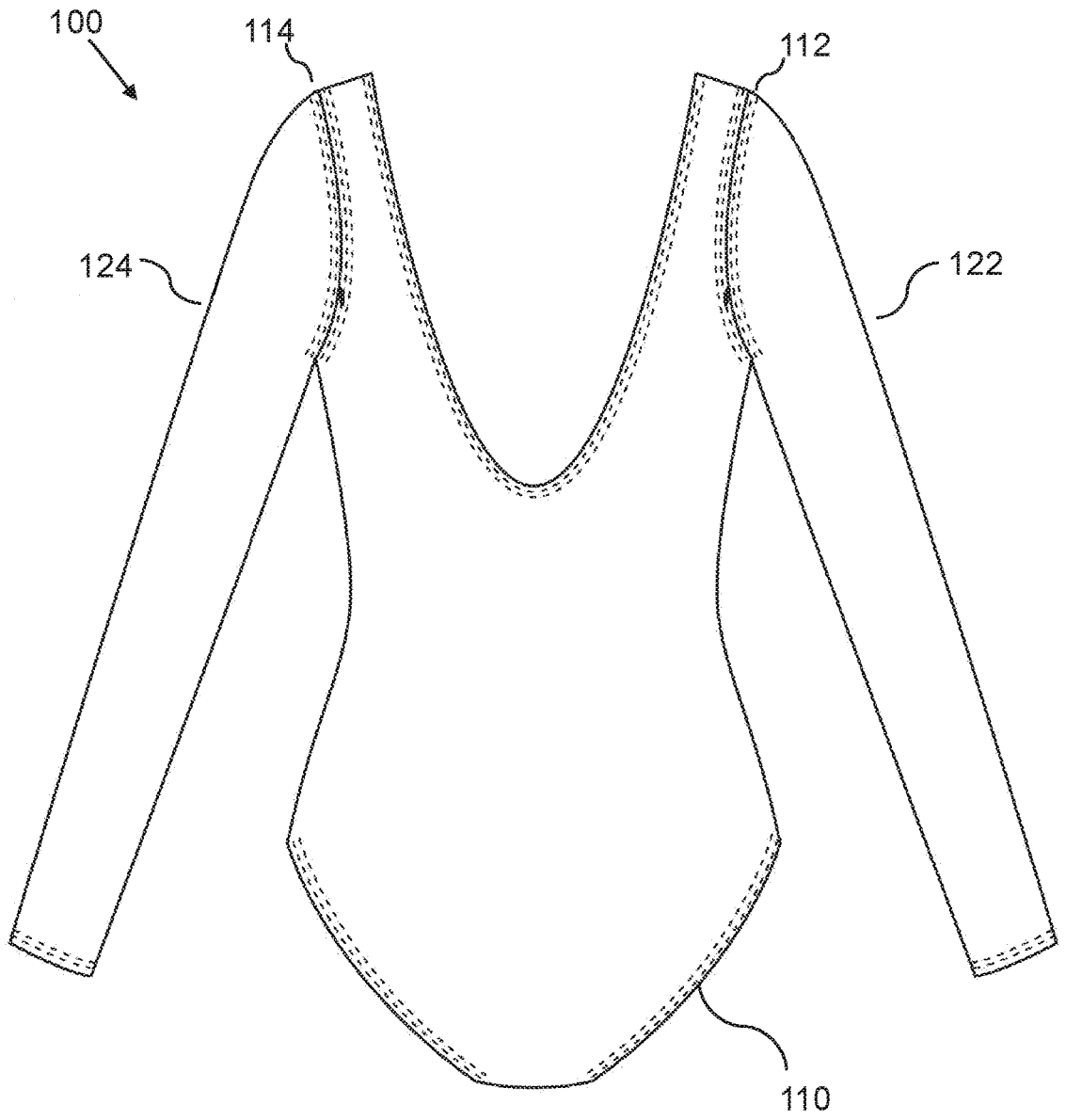
FIG. 2 is a rear view of an adaptable leotard with removable sleeves, according to an embodiment of the invention.

In an embodiment, as shown in FIGS. 1 and 2, an adaptable garment 100, which for example can be an adaptable shirt, an adaptable jacket, an adaptable unitard, an adaptable bodysuit, an athletic garment with interchangeable ventilated sleeves, or an adaptable leotard 100, can include:

a) a garment body 110, such as a leotard body 110; and b) right and left removable sleeves 122 124, which are removably attached to respectively right and left arm openings 112 114 of the leotard body 110.

Figure 3:
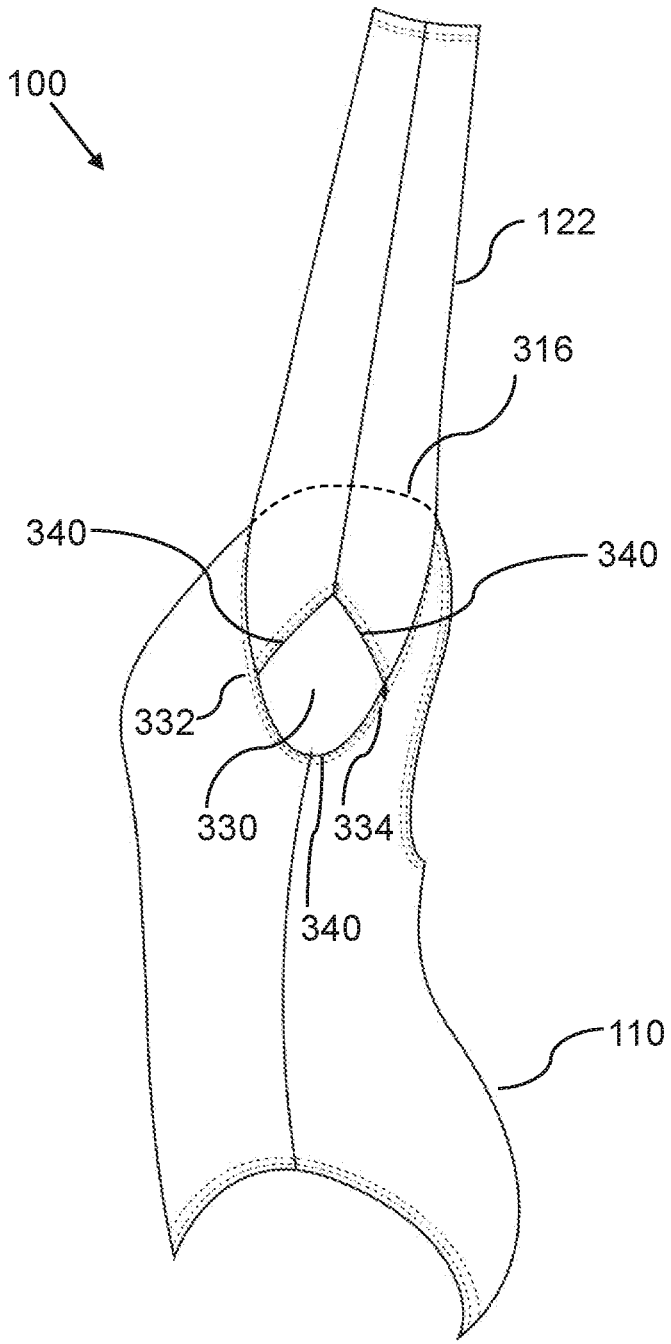
FIG. 3 is a side view of an adaptable leotard with removable sleeves, according to an embodiment of the invention.

In a related embodiment, as shown in FIG. 3, each of the right and left removable sleeves 122 124 can be attached to respectively a right and left partial upper periphery 316 of each of respectively the right and left arm openings, from a front attachment point 332 to a rear attachment point 334, such that that there is an armpit aperture 330 defined between the leotard body and the removable sleeve 112 114, the armpit aperture 330 positioned in respectively the right and left armpits of a user wearing the adaptable leotard 100. The armpit aperture can for example be substantially diamond shaped, substantially oval, or as shown, diamond/oval shaped with an upper triangular/diamond shape and a lower oval shape. The partial connection of the right and left removable sleeves 122 124 to respectively the right and left partial upper periphery 316, allow for a tight fit when worn, because the non-connected segments 340, which surround the armpit aperture 330, can stretch and therefore adapt to the user. Further, the right and left apertures 330 provide ventilation and reduce perspiration of the user, which increases the life span of the adaptable leotard 100 and reduces the risk of discoloration and related degradation of the adaptable leotard 100.

In a related embodiment, the garment body 110 and the right and left removable sleeves 122 124 can be made from a stretch fabric, such as LYCRA™, Spandex, and similar stretch fabrics.

Figure 4:
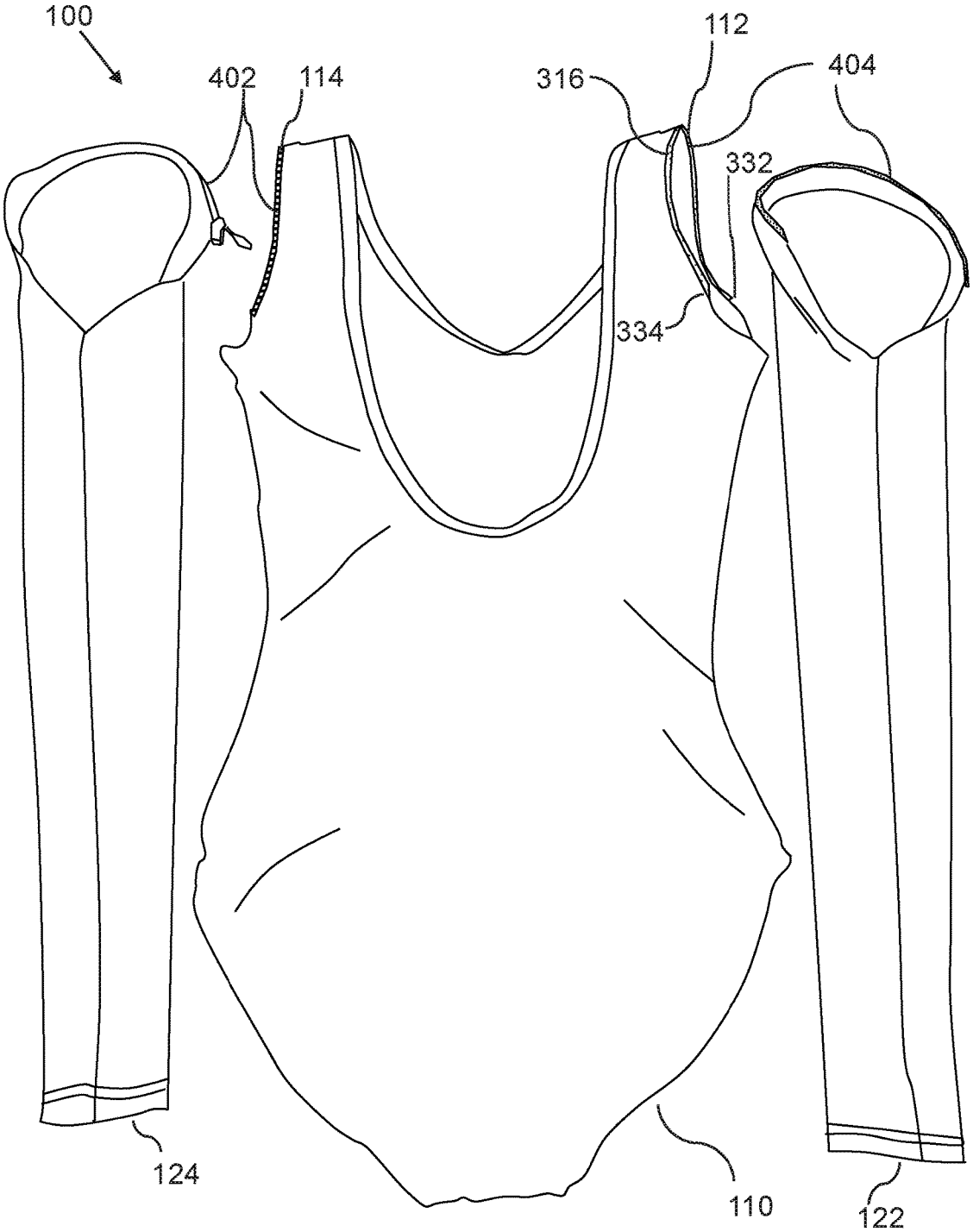
FIG. 4 is a rear view of an adaptable leotard with removable sleeves detached, according to an embodiment of the invention.

In a related embodiment, as shown in FIG. 4, the right and left removable sleeves 122 124 can each be attachable with zippers 402 to a partial upper periphery 316 of each of respectively the right and left arm openings. Alternatively, hook and loop fastener 404, or other types of fasteners can be used. The zippers 402 can be sewn with conventional design details, for example as lap zippers 402, using flaps to cover the zippers, or as so-called invisible zippers 402.

Figure 5:
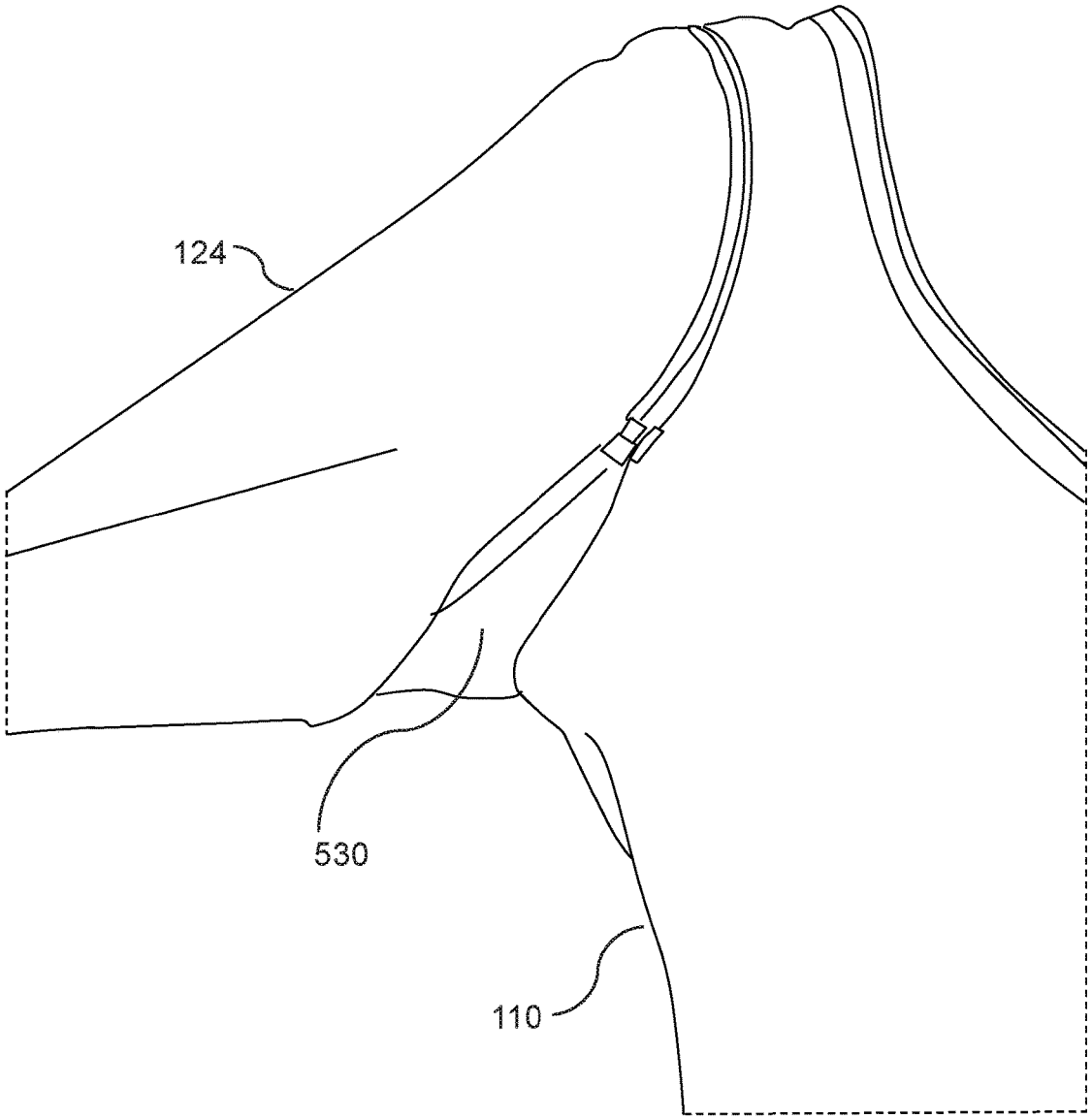
FIG. 5 is a front view of part of an adaptable leotard with removable sleeves, according to an embodiment of the invention.

FIG. 5 shows a right removable sleeve 122 attached to the leotard body 110, such that the adaptable leotard 100 has a right armpit aperture 530.

Figure 6:
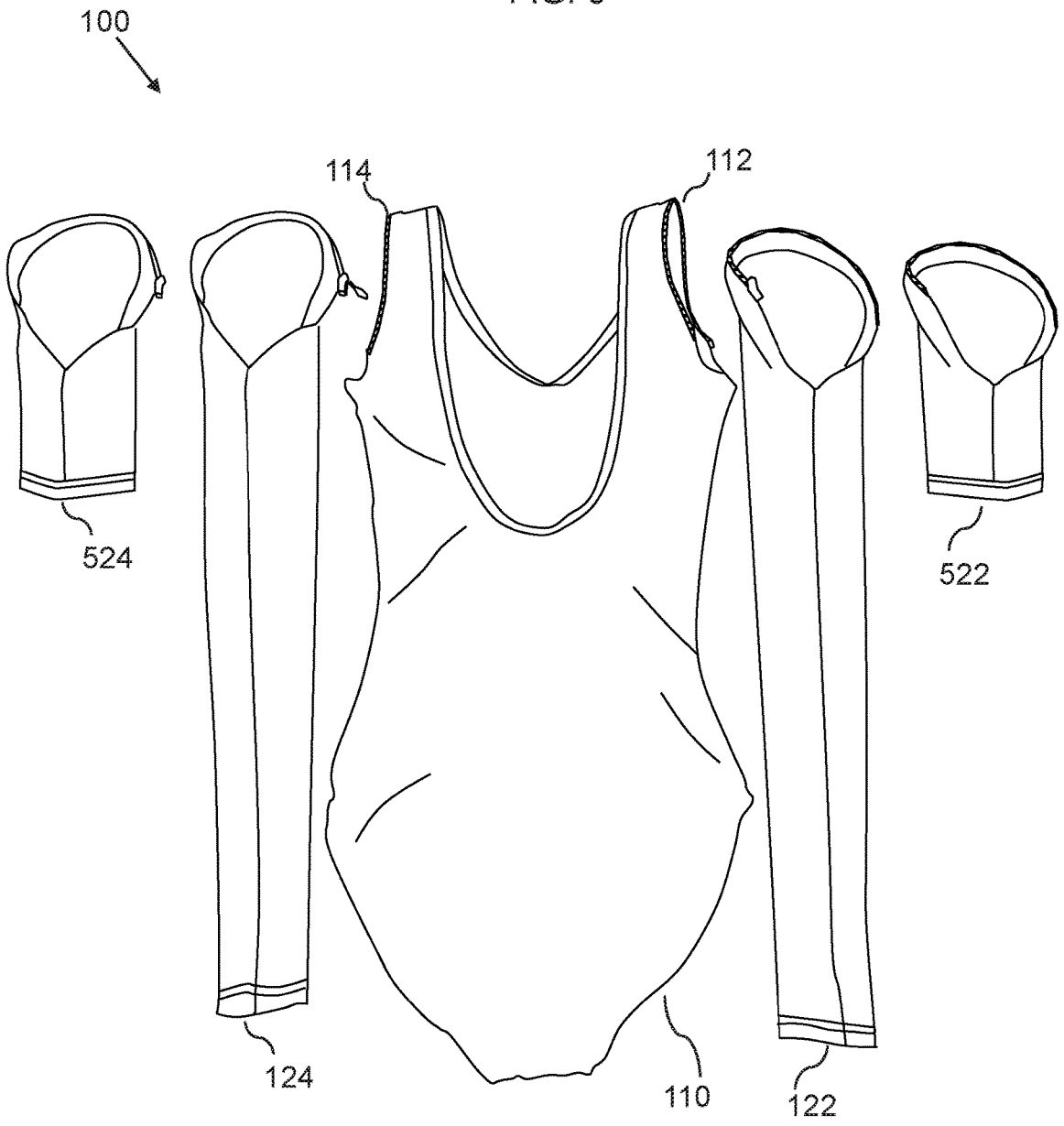
FIG. 6 is a rear view of an adaptable leotard system, according to an embodiment of the invention.

In an embodiment, as shown in FIG. 6, an adaptable garment system 100 can include:

a) a garment body 110, shown from the rear in FIG. 6; and b) A plurality of removable sleeve pairs, including:

i. A first pair of removable sleeves, including:

First right and left removable sleeves 122 124, which are removably attachable to respectively right and left arm openings 112 114 of the garment body 110; and ii. A second pair of removable sleeves, including:

Second right and left removable sleeves 522 524, which are removably attachable to respectively the right and left arm openings 112 114 of the leotard body 110.

In a related embodiment, as shown in FIG. 5, the first right and left removable sleeves 122 124 can be configured as a pair of long sleeves, and the second right and left removable sleeves 522 524 can be configured as a pair of short sleeves.

In related embodiments, the plurality of removable sleeve pairs can include a plurality of sleeves configured with different styles, design, lengths, colors, and/or patterns. Different length removable sleeve pair can for example include bicep-length short sleeves, ¾ length sleeves that reach to the forearm, and long sleeves that reach to the wrist.

Here has thus been described a multitude of embodiments of the adaptable garment 100, and systems and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. An adaptable garment, comprising:

a) a garment body, comprising right and left arm openings; and b) a left removable sleeve, which is removably attached to the left arm opening; and c) a right removable sleeve, which is removably attached to the right arm opening;

wherein the adaptable garment is an adaptable leotard, such that the garment body is a leotard body;

wherein the right removable sleeve is attachable solely to a right partial upper periphery of the right arm opening, from a front right attachment point to a rear right attachment point, such that a right armpit aperture is defined between the garment body and the right removable sleeve; and wherein the left removable sleeve is attachable solely to a left partial upper periphery of the left arm opening, from a front left attachment point to a rear left attachment point, such that a left armpit aperture is defined between the garment body and the left removable sleeve;

such that the right and left armpit apertures provide ventilation and reduce perspiration.

2. The adaptable garment of claim 1, wherein the right and left removable sleeves are attached to the garment body with zippers.

3. The adaptable garment of claim 1, wherein the right and left removable sleeves are attached to the garment body with hook and loop fastener.

4. The adaptable garment of claim 1, wherein the garment body and the right and left removable sleeves are made from a stretch fabric.

5. An adaptable garment system, comprising:

a) a garment body, comprising right and left arm openings; and b) a plurality of removable sleeve pairs, comprising:

a first pair of removable sleeves, comprising:

a first right removable sleeve, which is configured to be removably attachable to the right arm opening; and a left first removable sleeve, which is configured to be removably attachable to the left arm opening.

a second pair of removable sleeves, comprising:

a second right removable sleeve, which is configured to be removably attachable to the right arm opening; and a second left removable sleeve, which is configured to be removably attachable to the left arm opening;

wherein the adaptable garment is an adaptable leotard, such that the garment body is a leotard body;

wherein the first right removable sleeve is configured to be attachable solely to a right partial upper periphery of the right arm opening, from a front right attachment point to a rear eight attachment point, such that a first right armpit aperture is defined between the garment body and the first right removable sleeve;

wherein the left first removable sleeve is configured to be attachable solely to a left partial upper periphery of the left arm opening, from a front left attachment point to a rear left attachment point, such that a first left armpit aperture is defined between the garment body and the left first removable sleeve;

wherein the second right removable sleeve is configured to be attachable solely to the right partial upper periphery of the right arm opening, from the front right attachment point to the rear right attachment point, such that a second right armpit aperture is defined between the garment body and the second right removable sleeve; and wherein the second left removable sleeve is configured to be attachable solely to the left partial upper periphery of the left arm opening, from the front left attachment point to the rear left attachment point, such that a second left armpit aperture is defined between the garment body and the second left removable sleeve;

such that the first right, first left, second right, and second left armpit apertures provide ventilation and reduce perspiration.

6. The adaptable garment system of claim 5, wherein the first and second pair of removable sleeves each are configured to be attachable to the garment body with zippers.

7. The adaptable garment system of claim 5, wherein the right and left removable sleeves each are configured to be attachable to the garment body with hook and loop fastener.

8. The adaptable garment system of claim 5, wherein the garment body and the right and left removable sleeves are made from a stretch fabric.

* * * * *